United States Patent [19]

Boser

[11] 4,131,077

[45] Dec. 26, 1978

[54] METHOD OF ATTACHING A SLIDE FASTENER TO AN ARTICLE

[75] Inventor: Ronald J. Boser, Huntington Station, N.Y.

[73] Assignee: B & W Manufacturing Co., Inc., New York, N.Y.

[21] Appl. No.: 544,522

[22] Filed: Jan. 27, 1975

Related U.S. Application Data

[60] Continuation of Ser. No. 392,404, Aug. 28, 1973, abandoned, which is a division of Ser. No. 222,863, Feb. 2, 1972, Pat. No. 3,777,314.

[51] Int. Cl.[2] ..... D05B 3/12

[52] U.S. Cl. ..... 112/265

[58] Field of Search ..... 112/104, 163, 167, 221, 112/262, 265

[56] References Cited

U.S. PATENT DOCUMENTS

| | | | |
|---|---|---|---|
| 2,307,540 | 1/1943 | Pesdatella | 112/265 |
| 2,746,412 | 5/1956 | Roseman | 112/262 |
| 3,078,468 | 2/1963 | Piccione | 112/265 |
| 3,225,429 | 12/1965 | Fady | 112/265 X |

FOREIGN PATENT DOCUMENTS

| | | | |
|---|---|---|---|
| 780820 | 8/1957 | United Kingdom | 112/167 |

*Primary Examiner*—Werner H. Schroeder
*Attorney, Agent, or Firm*—O'Brien and Marks

[57] ABSTRACT

A method of attaching a slide fastener from a continuous chain to a garment or other article by a pair of stitching threads each running longitudinally along a respective one of the fastener tapes, at least one of the stitching threads continuing transversely across the slide fastener to form a bottom stop and to attach the fastener tapes together and to the article for reinforcement.

3 Claims, 6 Drawing Figures

METHOD OF ATTACHING A SLIDE FASTENER TO AN ARTICLE

CROSS REFERENCE TO RELATED APPLICATION

This is a continuation of pending application Ser. No. 392,404, filed Aug. 28, 1973, now abandoned, as a divisional application of pending application Ser. No. 222,863 filed Feb. 2, 1972, now Pat. No. 3,777,314.

BACKGROUND OF THE INVENTION

1. Field of the Invention

The present invention relates to the method of attachment of a continuous slide fastener chain to a garment or other article such that a bottom stop is provided by the stitching threads and the garment is reinforced.

2. Description of the Prior Art

In providing articles such as garments with slide fasteners, it is generally the practice to first form continuous slide fastener chain which is then processed such that bottom stops, made of metal, plastic or the like, are applied to the chain at spaced intervals dependent upon the desired length of the finished slide fastener for the garment. The processed chain is thereafter cut into individual slide fasteners which are sewn to the garment by any of various well known techniques. It has been found that the process of applying bottom stops to the continuous chain is both costly and time consuming and also limits the ultimate use of each processed chain roll to those applications calling for a fastener of the length fixed by the spacing between adjacent bottom stops. While these factors have been known for some time and have proven to be serious disadvantages ultimately resulting in the higher cost of consumer products using slide fasteners, an effective solution heretofore has been unavailable.

SUMMARY OF THE INVENTION

The present invention is summarized by the method of attaching a slide fastener from a continuous chain to a garment or other article by sewing the tapes of the chain to the garment by first and second spaced parallel lines of stitches longitudinal of the slide fastener chain, and sewing the first and second tapes to each other and to the garment by continuing the first line of stitches transversely of the slide fastener chain toward the second line of stitches to form a bottom stop.

Accordingly, it is an object of the present invention to attach continuous slide fastener chain to various garments or other articles without having to first apply bottom stops to the chain.

Another object of this invention is to reinforce a garment or other article at a point adjacent the bottom of an installed slide fastener during attachment thereof.

The present invention has a further object in that a slide fastener is attached to a garment, a bottom stop is formed for the slide fastener and the garment is reinforced in one operation.

Further objects and advantages of the present invention will become apparent from the description of the preferred embodiment as shown in the accompanying drawing.

DESCRIPTION OF THE PREFERRED EMBODIMENT

Figures 1, 2, 3, 4, 5, 6:
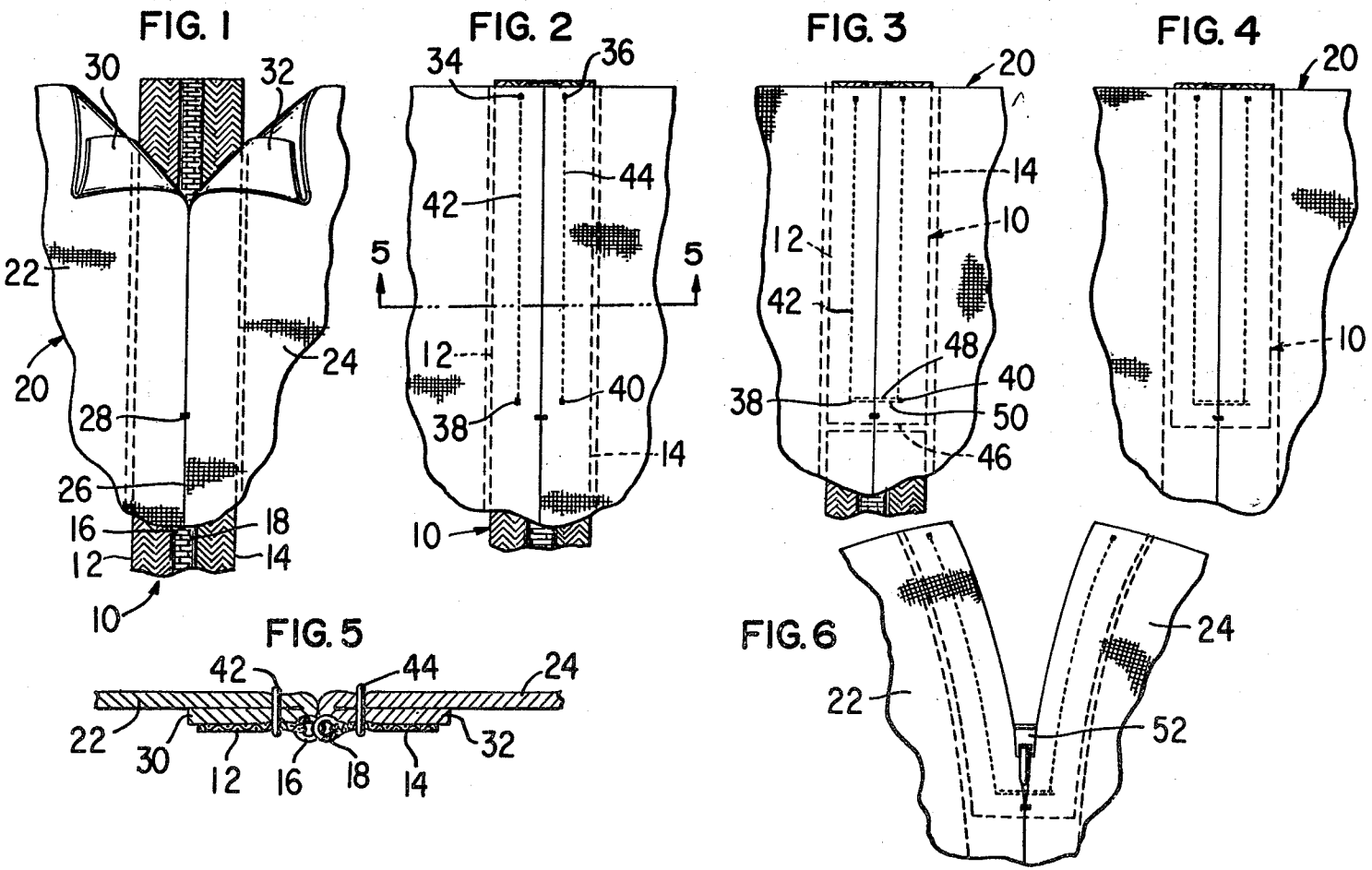
FIG. 1 is a partial plan view of a garment in position over a length of continuous slide fastener chain prior to its installation with the garment in accordance with the method of attachment of the present invention.
FIGS. 2–4 are partial plan views similar to FIG. 1, illustrative of the method of attachment according to the present invention.
FIG. 5 is a partial sectional view taken on line 5—5 of FIG. 2.
FIG. 6 is a partial plan view of a finished garment having a slide fastener attached by the method of the present invention.

The present method of attaching a slide fastener may be employed to attach or install any of various types of slide fastener chain with lined or unlined articles such as garments, tents, shoes or the like as desired to provide the finished product in accordance with the present invention. For exemplary purposes only and for the sake of brevity, the present invention will be described in connection with only one type of slide fastener chain for installation with an unlined garment such as a dress. It is also noted that since the present invention may be utilized with many diverse items which have need for a slide fastener, such as garments, rubber boots, pocketbooks, woven and non-woven coverings made from synthetic or natural materials, etc., and which are not collectively referred to by a single generic term, it should be understood that the word "article" as used in this specification is intended as being generic to items of this general class.

Referring to the drawing, the finished article of the present invention includes a severed portion of a continuous slide fastener chain, indicated generally at 10, including first and second elongated tapes 12 and 14 each having a set of coupling elements 16 and 18, respectively, attached along a longitudinal edge of the tapes by any suitable means such as threads. The uncut chain 10 is adapted to be stored on rolls or in bins (not shown) with the two sets of coupling elements 16 and 18 interengaged such that the chain may be drawn onto a suitable work station and held generally flat as illustrated in FIG. 1.

An article such as a garment 20 to which chain 10 is attached, includes first and second fabric portions 22 and 24 which are joined by a seam 26 terminating at a point 28 spaced from the border of the garment so as to define a slit or opening to be joined by the slide fastener. As shown in FIGS. 1 and 5, the seam allowances 30 and 32 of fabric portions 22 and 24, respectively are folded and pressed back and may be stitched in place as is well known.

Extending from points 34 and 36 to points 38 and 40, respectively, are two parallel lines of stitches 42 and 44 which attach the tapes 12 and 14 to fabric portions 22 and 24, respectively, of garment 20 on opposite sides of the seam opening. Points 38 and 40 are disposed adjacent the seam termination point 28 such that the garment may be fully closed by the slide fastener. Tapes 12 and 14 are transversely cut from the continuous chain 10 at line 46 which is longitudinally spaced from point 28 by approximately one-half inch. As shown in FIG. 3, the line of stitching threads 42 continues transversely across the slide fastener chain 10 from point 38 to point 40 as shown at 48 and then continues back across the chain 10 as shown at 50. In this manner, stitching threads 48 and 50 provide a bottom stop for the installed slide fastener and attach both tapes to each other as well as to the garment 10 to reinforce the garment at the seam termination point 28. A slider 52 is supported on the coupling elements of tapes 12 and 14 in the conventional manner and the border of the garment 20 may be finished as desired.

Referring to FIGS. 1–4, which sequentially illustrate the method of attaching the slide fastener chain 10 with garment 20 according to the present invention, the lead end of continuous chain 10 is guided into a position under a suitable sewing apparatus (not shown) which includes a pair of spaced, sewing needles aligned transversely of the chain. Garment 20 is then placed over the chain 10 with the garment opening centered above the interengaged coupling elements 16 and 18 and the border of the garment aligned with or slightly spaced from the end of the chain as shown in FIG. 1. As shown in FIG. 2, prior to the start of the sewing operation, the two sewing needles are located above points 34 and 36 near the border of the garment. Once the chain 10, garment 20 and needles are in their proper relative positions, the needles are activated and the garment and chain fed under the needles such that the two parallel lines of stitches 42 and 44 are applied on opposite sides of the seam to attach the tapes 12 and 14, respectively, to the garment portion 22 and 24. The parallel stitching continues until a point just above the seam termination point 28 is sensed whereupon the sewing apparatus is deenergized such that stitches 42 and 44 end at points 38 and 40, respectively. Thereafter, the right needle, as visualized in FIG. 3, is retracted from operative engagement with the garment and disabled from applying additional stitches thereto. The sewing thread for stitches 44 is then severed to complete the right line of stitches.

After the two parallel lines of stitches 42 and 44 are nearly completed and the proximity of the sewing apparatus and the seam termination point 28 is sensed, a suitable cutting device (not shown) is actuated to sever the continuous slide fastener chain from the sewn tape portions at line 46 (FIG. 3). It is noted that the severance line 46 is preferably located near the seam termination point 28 so that only a short tail is left on the attached slide fastener chain 10. In this manner, a new lead end of the continuous slide fastener chain is provided for subsequent operations and the garment and attached tape portions may be freely moved separate from the remaining supply of chain.

Once the above-described parallel stitching step is complete and the right needle retracted, the left needle is further actuated so as to apply stitches 48 to the garment using the unbroken or continuous threads previously used to form stitches 42. Since the garment is free to move, it may be easily transposed to the left during this step whereupon the line of stitches 48 is applied transversely of the chain, with the garment thereafter being returned to the right to apply transverse stitches 50. Stitches 48 and 50 thus attach tapes 12 and 14 to each other as well as to the garment 20 such that a bottom stop is provided for the finished product and further that the two transverse lines of stitches 48 and 50 accept the transverse load generated when the completed slide fastener is open. In view of this latter fact, it is preferable that stitches 48 and 50 be located slightly above the seam termination point 28 as shown in FIG. 3.

The thread used for stitches 42, 48 and 50 is then cut and the garment as shown in FIGS. 4 and 5 is brought to another station where a slider 52 can be secured to the fastener over the top coupling elements located at the lead end of the now attached slide fastener.

It is noted that a slide fastener from a continuous chain may be attached to a lined garment or other article in the identical manner described above with the tapes disposed on one side of the fabric-lining combination or disposed between the lining and the garment material as desired.

It can be appreciated that the present invention is advantageous over the prior art in that the continuous slide fastener chain is used directly from the roll without having been previously equipped with bottom stops at fixed intervals. This obviates the costly and time consuming process of selecting the length of the slide fasteners and applying the bottom stops to the continuous chain at the preselected spacing. Of course, this also obviates the need to purchase, maintain and operate the bottom stop applying apparatus. The present invention is also advantageous in that each roll of unprocessed or bottom stop-less continuous slide fastener chain may be attached to garments or other articles having different length requirements at random, since the bottom stop for each article will be formed at the proper location during attachment on a custom-made basis. As noted above, the present invention also provides inherent reinforcement of the installed slide fastener and the garment at the point where reinforcement is most needed; i.e., at the seam termination point.

Inasmuch as the present invention is subject to many variations, modifications and changes in detail, it is intended that all matter contained in the foregoing description or shown in the accompanying drawing shall be interpreted as illustrative and not in a limiting sense.

What is claimed is:

1. A method of installing a continuous slide fastener chain to a garment, the slide fastener chain having a leading end, and a trailing portion extending from the leading end, the slide fastener chain being of the type including first and second elongated tapes; the garment having a border, a seam termination point and opposed sides including the seam termination point, the opposed sides defining an opening extending from the seam termination point to the border of the garment, first and second sets of interengaged coupling elements attached to the first and second tapes, said slide fastener chain throughout its length being without a slider connected to the first and second sets of coupling elements, said method comprising the steps of placing the garment in superposition with the leading end of the continuous slide fastener chain such that the opening of the garment is longitudinally aligned over the interengaged coupling elements at the leading end of the slide fastener chain;

sewing first and second parallel spaced lines of stitches to the first and second tapes at the leading end of the slide fastener chain and to the opposite sides of the garment thereby initially attaching the superposed garment to the leading end of the slide fastener chain, the first and second lines of stitches extending in a direction from adjacent the border to adjacent the seam termination point;

transversely cutting the first and second sewn tapes from the first and second tapes of the trailing portion of the slide fastener chain at a point longitudinally spaced from the opening and disposed adjacent the sewn termination point;

continuing the sewing of the first line of stitches in another direction from the first line of stitches to the second line of stitches and transversely of the first and second tapes across the first and second sets of coupling elements; the continuing of the sewing of the first line of stitches forming a third line of stitches to further attach the first and second tapes of the leading end of the slide fastener chain to opposite sides of the garment, reinforcing the seam termination point and forming a bottom stop for the leading end of the slide fastener chain; and securing a slider to the interengaged coupling elements at the leading end of the slide fastener chain attached to the opposite sides of the garment.

2. The method according to claim 1 wherein said method includes the additional step of further continuing the sewing of the third line of stitches in a reverse direction from the second line of stitches to the first line of stitches and transversely of the first and second tapes of the attached slide fastener chain across the interengaged coupling elements so as to form a fourth line of stitches for further reinforcing the seam termination point and the bottom stop formed by the third line of stitches.

3. A method of installing a continuous slide fastener chain having first and second interengaged tapes with an article, said method comprising the steps of placing the article in superposition with the slide fastener chain, applying a first line of stitches longitudinally along with the first tape to attach the same to the article, applying a second line of stitches longitudinally along the second tape parallel with said first line of stitches to attach the second tape to the article, transversely cutting the attached first and second tapes from the continuous slide fastener chain at a point longitudinally spaced from said first and second lines of stitches, continuing to apply said second line of stitches transversely across the slide fastener chain to attach the first and second tapes to each other and to the article and to form a bottom stop for the attached slide fastener and to reinforce the article, and securing a slider over the top coupling elements at an end opposite to the bottom stop of the attached and cut fastener chain.

* * * * *